US012392522B2

(12) United States Patent
Longenecker et al.

(10) Patent No.: US 12,392,522 B2
(45) Date of Patent: Aug. 19, 2025

(54) AIR CONDITIONER UNIT AND METHOD FOR OPERATION

(71) Applicant: Haier US Appliance Solutions, Inc., Wilmington, DE (US)

(72) Inventors: Joshua Duane Longenecker, Louisville, KY (US); Timothy Scott Shaffer, Tipp City, OH (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 423 days.

(21) Appl. No.: 17/853,984

(22) Filed: Jun. 30, 2022

(65) Prior Publication Data

US 2024/0003585 A1 Jan. 4, 2024

(51) Int. Cl.
*F24F 11/00* (2018.01)
*F24F 11/88* (2018.01)

(52) U.S. Cl.
CPC ..... *F24F 11/88* (2018.01)

(58) Field of Classification Search
None
See application file for complete search history.

(56) References Cited

U.S. PATENT DOCUMENTS 6,766,222 B1 7/2004 Duley
8,299,646 B2 10/2012 Rockenfeller et al.
9,228,750 B2 1/2016 Rockenfeller et al.
9,459,634 B2 10/2016 Erwin et al.
2013/0013119 A1* 1/2013 Mansfield ..... G05D 23/1934 700/286
2015/0167998 A1* 6/2015 Saffre ..... F24F 11/46 700/276
2017/0089625 A1* 3/2017 Wallace ..... F25B 49/022
2021/0180822 A1* 6/2021 Kim ..... F24F 11/46

FOREIGN PATENT DOCUMENTS

WO WO2011036835 A1 3/2011

* cited by examiner

*Primary Examiner* — Paul B Yanchus, III
(74) *Attorney, Agent, or Firm* — Dority & Manning, P.A.

(57) ABSTRACT

A method for operating an appliance is provided. The appliance includes a plurality of power actuatable devices and a controller in operable communication with the plurality of power actuatable devices. The controller is configured to receive a control command corresponding to providing power to a first power actuatable device and determine whether a second power actuatable device is in a power receiving state below a power threshold or above the power threshold. When the power receiving state of the second power actuatable device is above the power threshold, the controller is configured to monitor the power receiving state of the second power actuatable device until the power receiving state is below the power threshold. When the power receiving state of the second power actuatable device is below the power threshold, the controller is configured to provide power to the first power actuatable device based on the control command.

13 Claims, 5 Drawing Sheets

AIR CONDITIONER UNIT AND METHOD FOR OPERATION

FIELD

The present disclosure generally pertains to systems and methods for operating an appliance, and, more specifically, to methods for operating an air conditioner unit.

BACKGROUND

Appliances, such as air conditioner units, require a power supply to provide power to power actuated devices such as fans, actuated vent doors, and stepper motors. Such devices are utilized to generate a desired heating or cooling, a desired flowrate, or a desired flow direction, and changes as desired as environmental conditions change or as a user may demand. When multiple devices need to operate simultaneously, a limited power supply may be unable to supply enough power to the appliance and result in uncommanded shutdown or unexpected behavior of the appliance.

A larger power supply can be utilized to supply sufficient power to operate all power actuated devices simultaneously. However, a larger power supply increases risks and hazards related to electric shock or fire.

Accordingly, a method and system for operating an appliance with a limited power supply is desired. More particularly, a method and system for operating an air conditioner device with a limited power supply is desired.

BRIEF DESCRIPTION

Aspects and advantages of the invention will be set forth in part in the following description, or may be obvious from the description, or may be learned through practice of the invention.

An aspect of the present disclosure is directed to an air conditioner unit. The air conditioner unit includes a plurality of power actuatable devices and a controller in operable communication with the plurality of power actuatable devices. The controller is configured to receive a control command corresponding to providing power to a first power actuatable device and determine whether a second power actuatable device is in a power receiving state below a power threshold or above the power threshold. The controller is configured to monitor the power receiving state of the second power actuatable device until the power receiving state is below the power threshold when the power receiving state of the second power actuatable device is above the power threshold. The controller is configured to provide power to the first power actuatable device based on the control command when the power receiving state of the second power actuatable device is below the power threshold.

Another aspect of the present disclosure is directed to a method for operating an appliance. The appliance includes a plurality of power actuatable devices. The method includes receiving a control command corresponding to providing power to a first power actuatable device and determining whether a second power actuatable device is in a power receiving state below a power threshold or above the power threshold. The method includes monitoring the power receiving state of the second power actuatable device until the power receiving state is below the power threshold when the power receiving state of the second power actuatable device is above the power threshold. The method includes providing power to the first power actuatable device based on the control command when the power receiving state of the second power actuatable device is below the power threshold.

Yet another aspect of the present disclosure is directed to a controller for an appliance. The controller includes a memory device and a processor. The memory device is configured to store instructions that, when executed by the processor, causes the controller to perform operations. The operations include receiving a control command corresponding to providing power to a first power actuatable device; determining whether a second power actuatable device is in a power receiving state below a power threshold or above the power threshold; monitoring the power receiving state of the second power actuatable device until the power receiving state is below the power threshold when the power receiving state of the second power actuatable device is above the power threshold; and generating a command signal corresponding to providing power to the first power actuatable device based on the control command when the power receiving state of the second power actuatable device is below the power threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
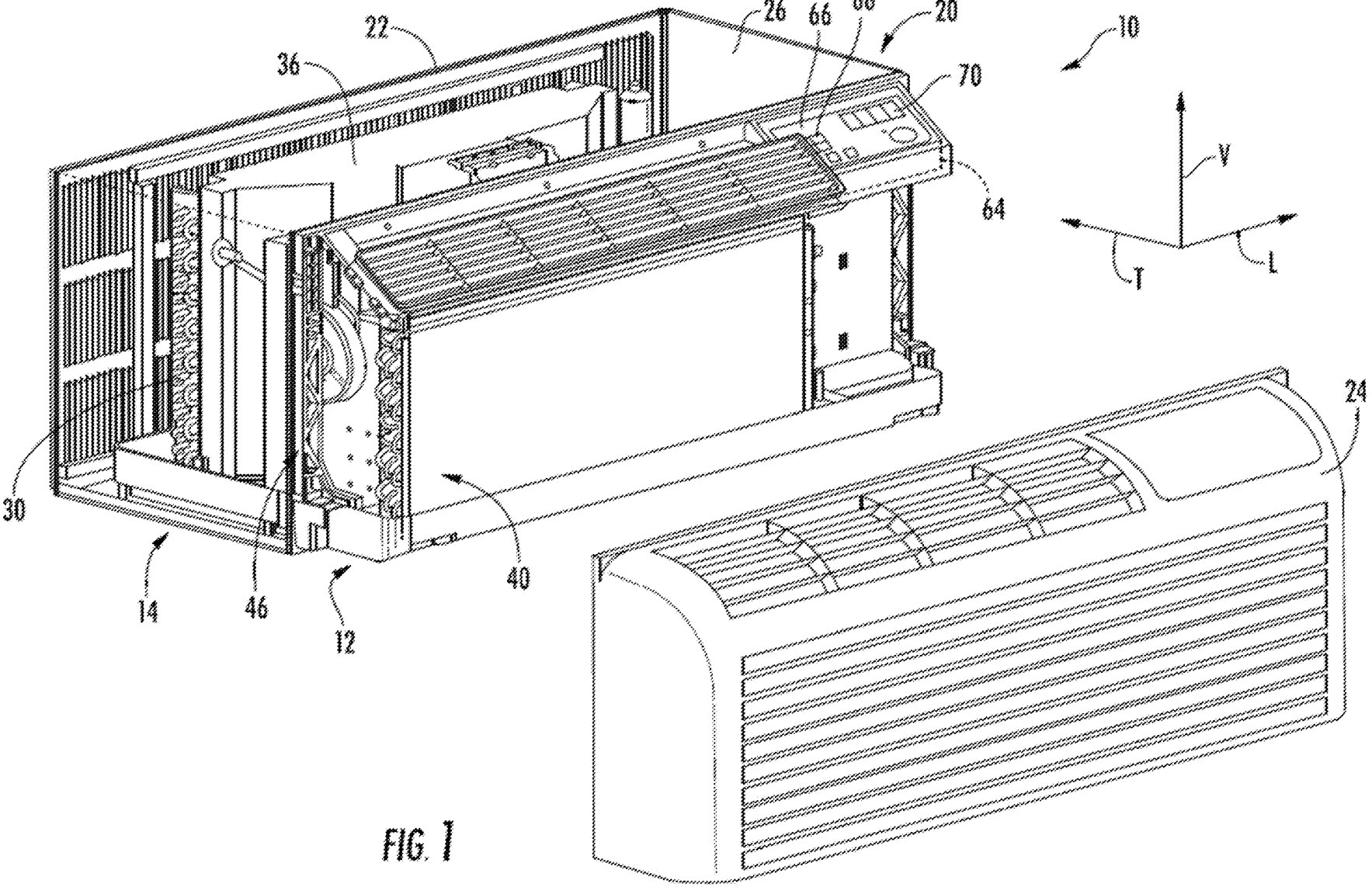
FIG. 1 provides a perspective view of an air conditioner unit, with part of an indoor portion exploded from a remainder of the air conditioner unit for illustrative purposes, in accordance with one exemplary embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment.

Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

Referring now to FIG. 1, an embodiment of an appliance is provided. In particular, the embodiment provided in FIG. 1 is an air conditioner unit 10. The air conditioner unit 10 is a one-unit type air conditioner, also conventionally referred to as a room air conditioner or a packaged terminal air conditioner (PTAC). The unit 10 includes an indoor portion 12 and an outdoor portion 14, and generally defines a vertical direction V, a lateral direction L, and a transverse direction T. Each direction V, L, T is perpendicular to each other, such that an orthogonal coordinate system is generally defined.

A housing 20 of the unit 10 may contain various other components of the unit 10. Housing 20 may include, for example, a rear grill 22 and a room front 24 which may be spaced apart along the transverse direction T by a wall sleeve 26. The rear grill 22 may be part of the outdoor portion 14, and the room front 24 may be part of the indoor portion 12. Components of the outdoor portion 14, such as an outdoor heat exchanger 30, an outdoor fan 32 (FIG. 2), and a compressor 34 (FIG. 2) may be housed within the wall sleeve 26. A casing 36 may additionally enclose outdoor fan 32, as shown.

Figure 2:
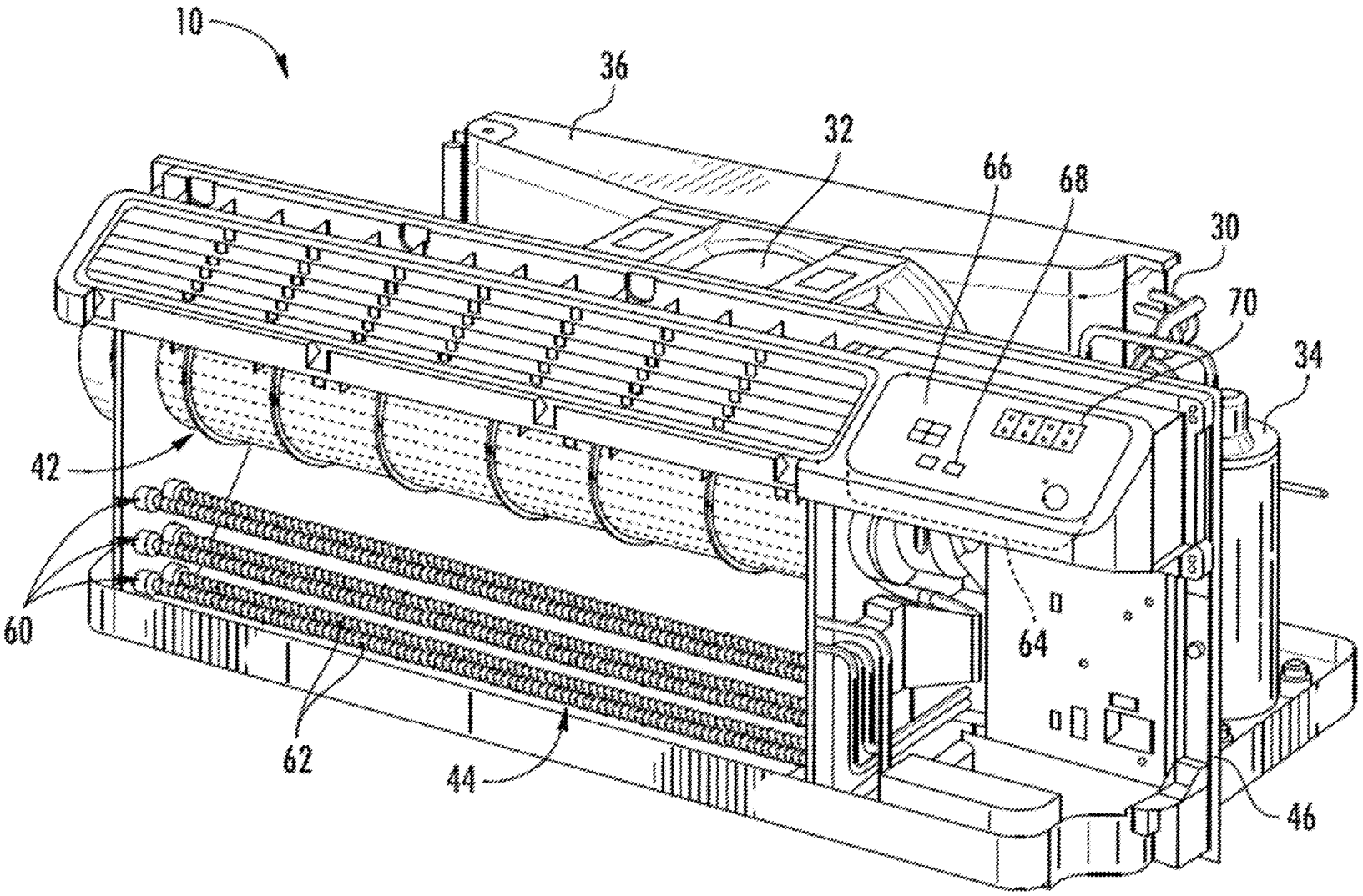
FIG. 2 is another perspective view of components of the indoor portion of the exemplary air conditioner unit of FIG. 1.

Referring now also to FIG. 2, indoor portion 12 may include, for example, an indoor heat exchanger 40 (FIG. 1), a blower fan or indoor fan 42, and a heating unit 44. These components may, for example, be housed behind the room front 24. Additionally, a bulkhead 46 may generally support and/or house various other components or portions thereof of the indoor portion 12, such as indoor fan 42 and the heating unit 44. Bulkhead 46 may generally separate and define the indoor portion 12 and outdoor portion 14.

Figure 3:
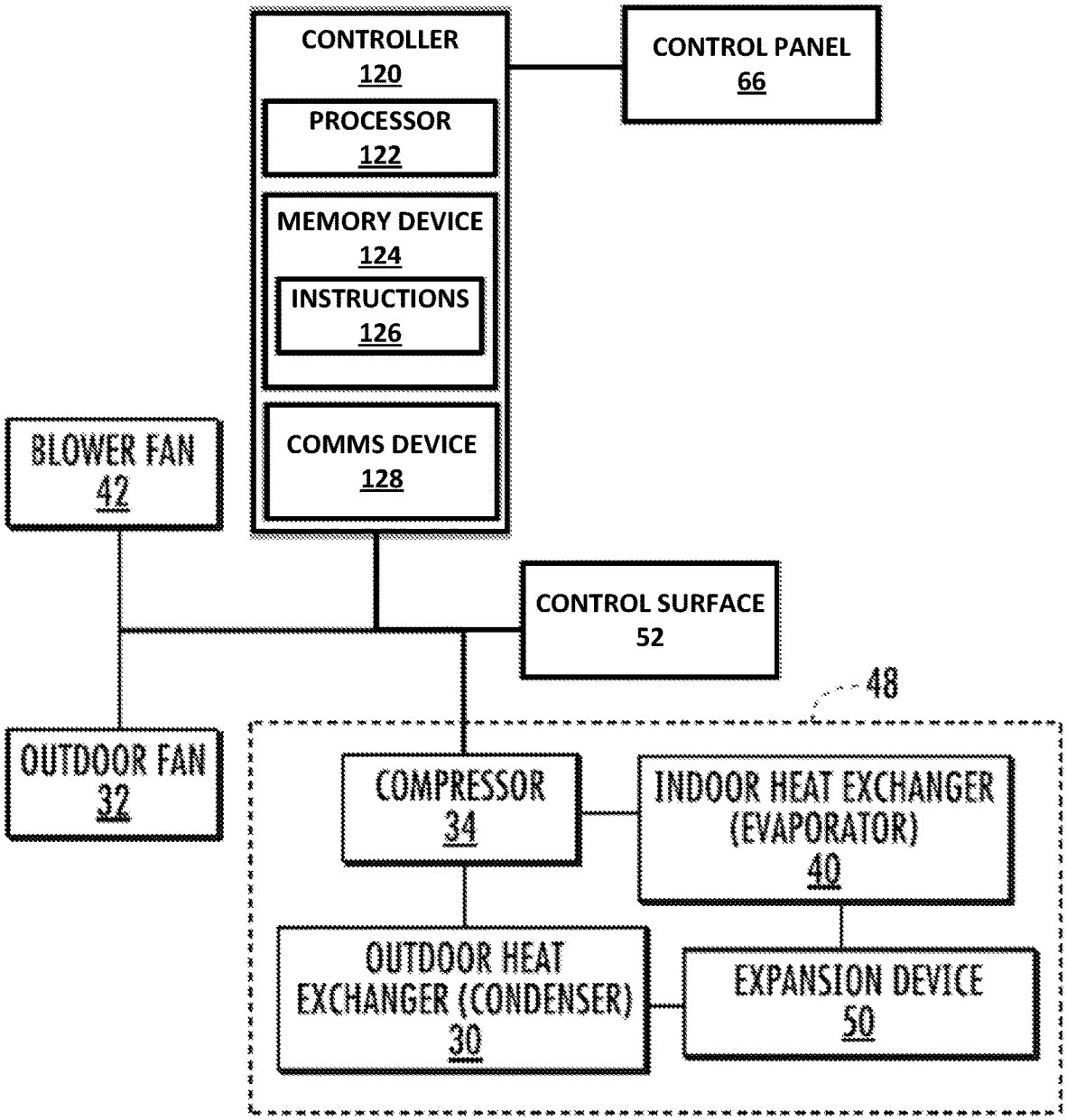
FIG. 3 is a schematic view of a refrigeration loop in accordance with one embodiment of the present disclosure.

Outdoor and indoor heat exchangers 30, 40 may be components of a refrigeration loop 48, which is shown schematically in FIG. 3. Refrigeration loop 48 may, for example, further include compressor 34 and an expansion device 50. As illustrated, compressor 34 and expansion device 50 may be in fluid communication with outdoor heat exchanger 30 and indoor heat exchanger 40 to flow refrigerant therethrough as is generally understood. More particularly, refrigeration loop 48 may include various lines for flowing refrigerant between the various components of refrigeration loop 48, thus providing the fluid communication there between. Refrigerant may thus flow through such lines from indoor heat exchanger 40 to compressor 34, from compressor 34 to outdoor heat exchanger 30, from outdoor heat exchanger 30 to expansion device 50, and from expansion device 50 to indoor heat exchanger 40. Expansion device 50 may include any appropriate static, mechanically actuatable, or electronically actuatable valve, restriction plate, or other appropriate flow control device. The refrigerant may generally undergo phase changes associated with a refrigeration cycle as it flows to and through these various components, as is generally understood. Suitable refrigerants for use in refrigeration loop 48 may include pentafluoroethane, difluoromethane, or a mixture such as R410a, although it should be understood that the present disclosure is not limited to such example and rather that any suitable refrigerant may be utilized.

As is understood in the art, refrigeration loop 48 may alternately be operated as a refrigeration assembly (and thus perform a refrigeration cycle) or a heat pump (and thus perform a heat pump cycle). As shown in FIG. 3, when refrigeration loop 48 is operating in a cooling mode and thus performs a refrigeration cycle, the indoor heat exchanger 40 acts as an evaporator and the outdoor heat exchanger 30 acts as a condenser. Alternatively, when the assembly is operating in a heating mode and thus performs a heat pump cycle, the indoor heat exchanger 40 acts as a condenser and the outdoor heat exchanger 30 acts as an evaporator. The outdoor and indoor heat exchangers 30, 40 may each include coils through which a refrigerant may flow for heat exchange purposes, as is generally understood.

According to an example embodiment, compressor 34 may be a variable speed compressor. In this regard, compressor 34 may be operated at various speeds depending on the current air conditioning needs of the room and the demand from refrigeration loop 48. For example, according to an exemplary embodiment, compressor 34 may be configured to operate at any speed between a minimum speed, e.g., 1500 revolutions per minute (RPM), to a maximum rated speed, e.g., 3500 RPM. Notably, use of variable speed compressor 34 enables efficient operation of refrigeration loop 48 (and thus air conditioner unit 10), minimizes unnecessary noise when compressor 34 does not need to operate at full speed, and ensures a comfortable environment within the room.

In exemplary embodiments as illustrated, expansion device 50 may be disposed in the outdoor portion 14 between the indoor heat exchanger 40 and the outdoor heat exchanger 30. According to the exemplary embodiment, expansion device 50 may be an electronic expansion device that enables controlled expansion of refrigerant, as is known in the art. More specifically, electronic expansion device 50 may be configured to precisely control the expansion of the refrigerant to maintain, for example, a desired temperature differential of the refrigerant across the indoor heat exchanger 40. In other words, electronic expansion device 50 throttles the flow of refrigerant based on the reaction of the temperature differential across indoor heat exchanger 40 or the amount of superheat temperature differential, thereby ensuring that the refrigerant is in the gaseous state entering compressor 34. According to alternative embodiments, expansion device 50 may be a capillary tube or another suitable expansion device configured for use in a thermodynamic cycle.

According to the illustrated exemplary embodiment, outdoor fan 32 is an axial fan and indoor fan 42 is a centrifugal fan. However, it should be appreciated that according to alternative embodiments, outdoor fan 32 and indoor fan 42 may be any suitable fan type. In addition, according to an exemplary embodiment, outdoor fan 32 and indoor fan 42 are variable speed fans. For example, outdoor fan 32 and indoor fan 42 may rotate at different rotational speeds, thereby generating different air flow rates. It may be desirable to operate fans 32, 42 at less than their maximum rated speed to ensure safe and proper operation of refrigeration loop 48 at less than its maximum rated speed, e.g., to reduce noise when full speed operation is not needed. In addition, according to alternative embodiments, fans 32, 42 may be operated to urge make-up air into the room.

According to the illustrated embodiment, indoor fan 42 may operate as an evaporator fan in refrigeration loop 48 to encourage the flow of air through indoor heat exchanger 40. Accordingly, indoor fan 42 may be positioned downstream of indoor heat exchanger 40 along the flow direction of indoor air and downstream of heating unit 44. Alternatively, indoor fan 42 may be positioned upstream of indoor heat exchanger 40 along the flow direction of indoor air, and may operate to push air through indoor heat exchanger 40.

Heating unit 44 in exemplary embodiments includes one or more heater banks 60. Each heater bank 60 may be operated as desired to produce heat. In some embodiments as shown, three heater banks 60 may be utilized. Alternatively, however, any suitable number of heater banks 60 may be utilized. Each heater bank may further include at least one heater coil or coil pass 62, such as in exemplary embodiments two heater coils or coil passes 62. Alternatively, other suitable heating elements may be utilized.

Operation of air conditioner unit 10 including compressor 34 (and thus refrigeration loop 48 generally), indoor fan 42, outdoor fan 32, heating unit 44, expansion device 50, heat exchangers 30, 40, control surfaces 52, and other components of refrigeration loop 48 may be controlled by a computing device such as a controller 120. Control surfaces 52 may include a vent actuatable between a first position or an open position through which air is flowable and a second position or closed position preventing or re-directing air flow. Controller 120 may be in communication (via for example a suitable wired or wireless connection) to such components of the air conditioner unit 10.

Unit 10 may additionally include a control panel 66 and one or more user inputs 68, which may be included in control panel 66. The user inputs 68 may be in communication with the controller 120. A user of the unit 10 may interact with the user inputs 68 to operate the unit 10, and user commands may be transmitted between the user inputs 68 and controller 120 to facilitate operation of the unit 10 based on such user commands. A display 70 may additionally be provided in the control panel 66, and may be in communication with the controller 120. Display 70 may, for example be a touchscreen or other text-readable display screen, or alternatively may simply be a light that can be activated and deactivated as required to provide an indication of, for example, an event or setting for the unit 10.

Referring to FIG. 3, an exemplary embodiment of controller 120 includes a processor 122, a memory device 124, and a communications module 128. The memory device 124 is configured to receive and store instructions 126 that, when executed by the processor 122, causes the air conditioner unit 10 to perform operations. The communications module 128 provides a wired or wireless communications bus to send and/or receive signals, such as operational commands based on the instructions 126, to blower fan 42, outdoor fan 32, compressor 34, heat exchangers 30, 40, and expansion device 50. The instructions 126 include one or more steps of method 1000, such as provided further herein.

Controller 120 may include any suitable electronics controller, power electronics device, motor, or electric machine configured selectively provide energy, control activation, or effectuate operation of various components to which controller 120 is operably coupled, such as described herein.

As used herein, the term "processor" refers not only to integrated circuits referred to in the art as being included in a computer, but also refers to a controller, microcontroller, a microcomputer, a programmable logic controller (PLC), an application specific integrated circuit (ASIC), a Field Programmable Gate Array (FPGA), and other programmable circuits. Additionally, the memory device may generally include memory element(s) including, but not limited to, computer readable medium (e.g., random access memory (RAM)), computer readable non-volatile medium (e.g., flash memory), or other suitable memory elements or combinations thereof.

Figure 4:
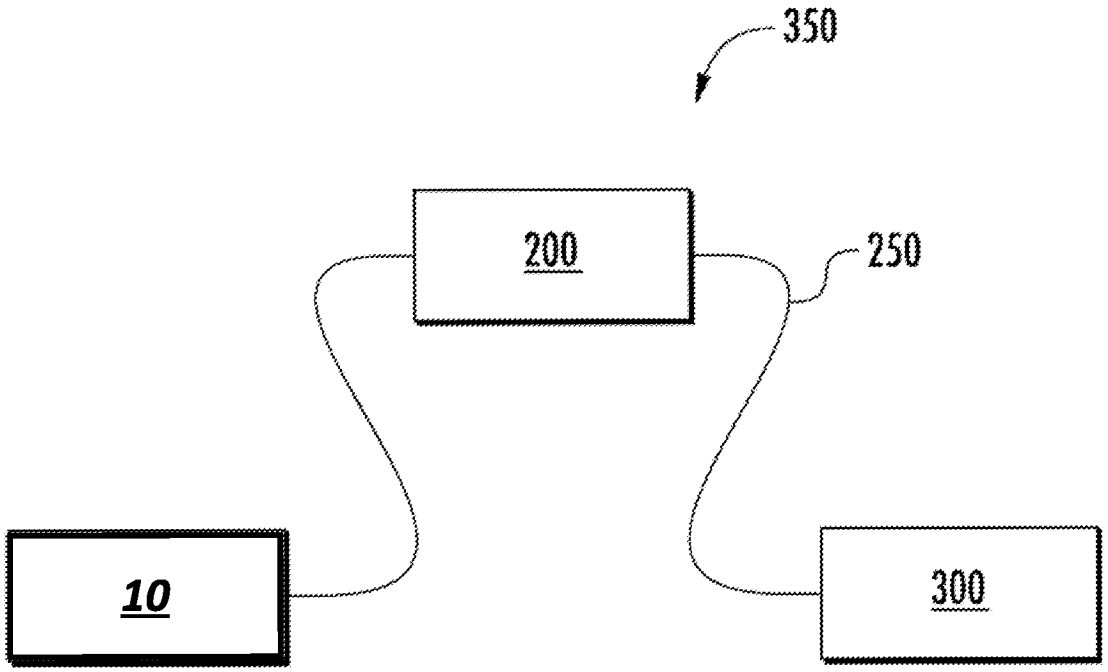
FIG. 4 is a schematic diagram of an external communication system in accordance with an embodiment of the present disclosure.

Referring now to FIG. 4, a schematic diagram of an external communication system 350 will be described according to an exemplary embodiment of the present subject matter. In general, external communication system 350 is configured for permitting interaction, data transfer, and other communications between air conditioner unit 10 and one or more external devices 300. For example, this communication may be used to provide and receive a control command, priority hierarchy, power threshold, power limit, power requirement, or other user instructions, notifications, user preferences, or any other suitable information for performance and operation of air conditioner unit 10. In a particular embodiment, the external device 300 may command execution of one or more steps of method 1000 at air conditioner unit 10. In addition, it should be appreciated that external communication system 350 may be used to transfer data or other information to improve performance of one or more external devices or systems and/or improve user interaction with such devices.

For example, external communication system 350 permits controller 120 to communicate with a separate external device 300 to air conditioner unit 10. As described in more detail below, these communications may be facilitated using a wired or wireless connection, such as via a network 250, cloud computing system, or distributed network. In general, external device 300 may be any suitable device separate from air conditioner unit 10 that is configured to provide and/or receive communications, information, data, or commands from a user. In this regard, external device 300 may be, for example, a personal phone, a smartphone, a tablet, a laptop or personal computer, a wearable device, a smart home system, or another mobile or remote device.

In addition, a remote server 200 may be in communication with air conditioner unit 10 and/or external device 300 through the network 250. In this regard, for example, remote server 200 may be a cloud-based server, and is thus located at a distant location, such as in a separate building, city, state, country, etc. According to an exemplary embodiment, external device 300 may communicate with the remote server 200 over network 250, such as the Internet, to transmit/receive data or information, provide user inputs, receive user notifications or instructions, interact with or control washing machine appliance 100, etc. In addition, external device 300 and remote server 200 may communicate with air conditioner unit 10 to communicate similar information.

In general, communication between air conditioner unit 10, external device 300, remote server 200, and/or other user devices may be carried using any type of wired or wireless connection and using any suitable type of communication network, non-limiting examples of which are provided below. For example, external device 300 may be in direct or indirect communication with air conditioner unit 10 through any suitable wired or wireless communication connections or interfaces, such as network 250. For example, network 250 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL). Particular portions of controller 120, such as the communications module 128, may be in operable communication with network 250, such as to receive or provide instructions, commands, etc. between external device 300 and memory device 124. External device 300 may accordingly command performance of steps of method 1000 at air conditioner unit 10.

External communication system 350 is described herein according to an exemplary embodiment of the present subject matter. However, it should be appreciated that the exemplary functions and configurations of external communication system 350 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

In various embodiments, communications, operations, and instructions such as described herein may be performed substantially internally at the air conditioner unit 10, such as at the controller 120, or at a combination of the controller 120 at the air conditioner unit 10 and the external communication system 350.

Figure 5:
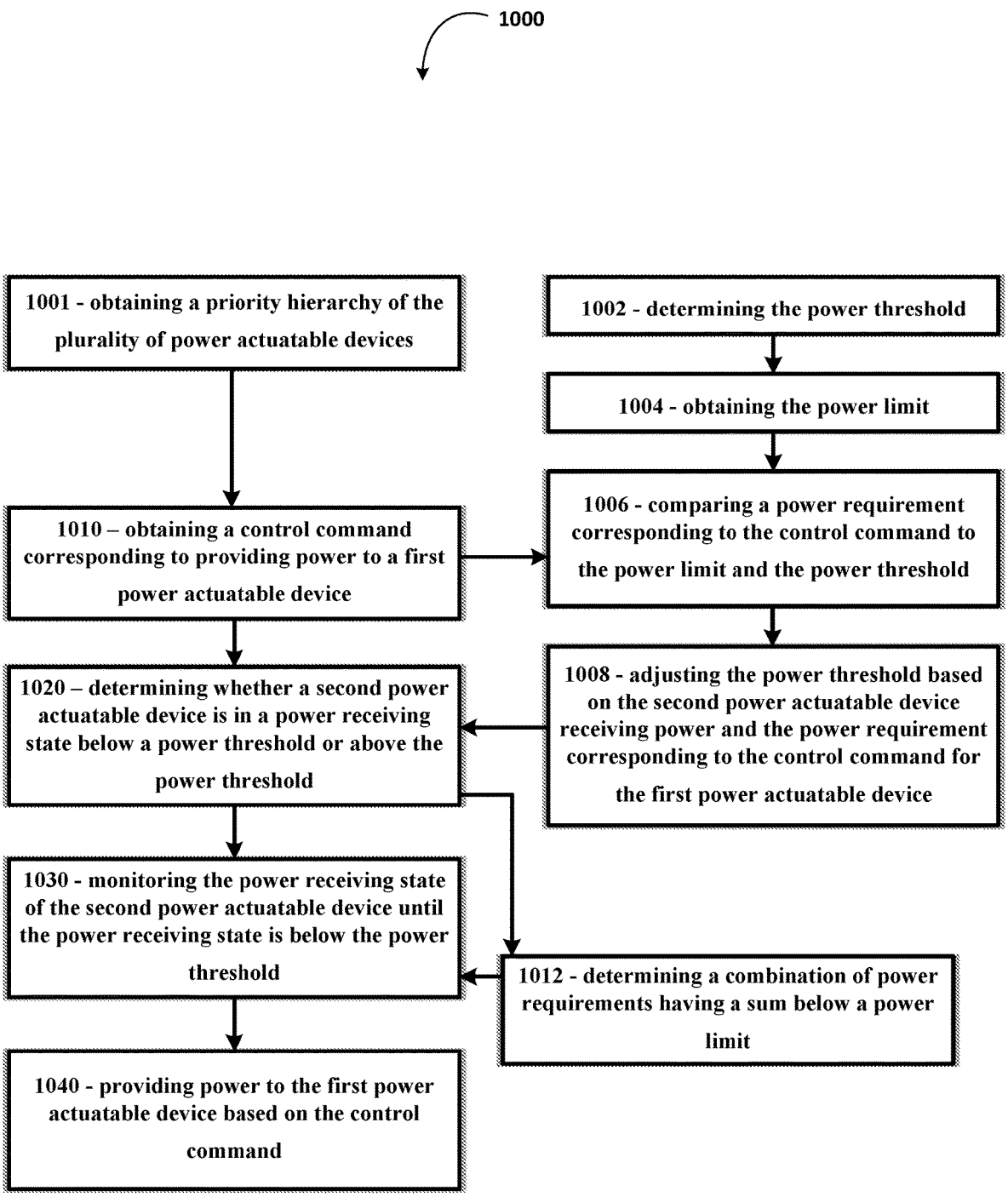
FIG. 5 is a flowchart outlining steps of a method for operating an appliance in accordance with embodiments of the present disclosure.

Referring now to FIG. 5, a flowchart outlining steps of a method for operating an appliance is provided (referred to herein as "method 1000"). Various steps of method 1000 may be received at controller 120 via communications device 128 and stored as instructions 126 at memory device 124. Processor 122 is configured to execute instructions 126, causing the air conditioner unit 10 to perform operations, such as one or more steps of method 1000. Embodiments of method 1000 may be stored or executed for appliances including a plurality of power actuatable devices. Certain embodiments of method 1000 are particularly directed to operating an air conditioner device. Still particular embodiments of method 1000 are directed to operating a packaged terminal air conditioner unit.

Method 1000 includes at 1010 receiving a control command corresponding to providing power to (or allowing power draw by) a first power actuatable device. Method 1000 includes at 1020 determining whether a second power actuatable device is in a power receiving state below a power threshold or above the power threshold. When the power receiving state of the second power actuatable device is above the power threshold, the method 1000 includes at 1030 monitoring the power receiving state of the second power actuatable device until the power receiving state is below the power threshold. When the power receiving state of the second power actuatable device is below the power threshold, the method 1000 includes at 1040 providing power to (or allowing power draw by) the first power actuatable device based on the control command.

The power actuatable devices include any combination of fans (e.g., outdoor fan 32, blower fan 42), compressors, (e.g., compressor 34), heat exchangers (e.g., condenser 30, evaporator 40), heating units (e.g., heating unit 44), expansion device (e.g., expansion device 50), control surface (e.g., control surface 52), or other devices at an air conditioner unit (e.g., air conditioner unit 10) configured to selectively operate based on selectively receiving or drawing power. The first power actuatable device includes any one or more of the aforementioned power actuatable devices and the second power actuatable device includes any one or more others of the aforementioned power actuatable devices at the air conditioner unit not included among the first power actuatable device.

The user may input a control command via a control panel (e.g., control panel 66). Additionally, or alternatively, the control command may be generated, transmitted, provided, and obtained from a control schedule stored as instructions in a computing device (e.g., stored as instructions 126 in the controller 120). The control schedule may include operating modes, conditions, charts, tables, graphs, curves, etc. corresponding to operating positions, speeds, angles, movements, or other actuation commands for power actuatable devices.

During an exemplary non-limiting embodiment of operation of method 1000, a user or control schedule transmits a control command corresponding to increasing fan speed. Accordingly, in such an embodiment, the first power actuatable device is the blower fan and the second power actuatable devices are the compressors, heat exchangers, expansion devices, control surfaces, and other devices at the air conditioner unit.

The power threshold is a difference of a power limit and a power input to the second power actuatable device. The power limit corresponds to a threshold above which a circuit may be overloaded or tripped, power supply to the air conditioner unit may be interrupted, or other dysfunction of operation of the air conditioner unit may occur. The power input to the second power actuatable device may correspond to a total amount or magnitude of power supplied to the second power actuatable devices.

The power receiving state may generally refer to power being provided to or drawn by the power actuatable device. The power receiving state may particularly refer to power draw greater than a minimum power draw that may be associated with operable electric connection of the device(s) to a power source. In a particular embodiment, the power receiving state refers to power draw associated with actuating, moving, articulating, or otherwise operating the power actuatable device. Operation of the power actuatable device includes, but is not limited to, inducing flow, generating pressure, transferring thermal energy, rotating rotors, moving or re-orienting vents, or changing areas or volumes of flow surfaces, etc.

Referring to the exemplary non-limiting embodiment of operation of method 1000 provided above, when the control command is received for operating the fan, method 1000 determines whether the power receiving state is below the power threshold or above the power threshold. For instance, when the control command is received, the second power actuatable device may include the compressors, heat exchangers, expansion devices, and control surfaces operating, such as drawing power above the power threshold. Method 1000 then monitors the power receiving state of the second power actuatable device until the power receiving state is below the power threshold, such as provided at 1030. When one or more second power actuatable devices decreases power draw or ceases operation, the power receiving state of the second power actuatable devices may decrease below the power threshold. Method 1000 then provides power to the first power actuatable device based on the control command, such as provided at 1040. In such a non-limiting embodiment, one or more of the compressors, heat exchangers, expansion devices, or control surfaces may reduce or cease power draw, resulting in the power receiving state of the second power actuatable devices to decrease below the power threshold and allowing the fan to then draw power based on the control command.

In certain embodiments, method 1000 includes at 1002 determining the power threshold. Method 1000 may include at 1004 obtaining the power limit. Method 1000 may include at 1006 comparing a power requirement corresponding to the control command to the power limit and the power threshold. Method 1000 may include at 1008 adjusting the power threshold based on the second power actuatable device receiving power and the power requirement corresponding to the control command for the first power actuatable device.

Referring to the exemplary non-limiting embodiment provided above, the control command corresponds to increasing fan speed and, accordingly, the fan is the first power actuatable device and one or more other devices (e.g., all other power actuatable devices) form the second actuatable device. The control command corresponding to increasing fan speed includes a corresponding power requirement for the first actuatable device. In another non-limiting embodiment, another control command corresponds to re-directing air flow and, accordingly, a control surface (e.g., a vent) is the first power actuatable device and one or more other devices form the second actuatable device. The control command corresponding to re-directing air flow includes a corresponding power requirement for the first actuatable device different from the control command corresponding to increasing fan speed. Method 1000 at 1002 may determine a first power threshold based on the combination of devices forming the second power actuatable devices when the first power actuatable device is the fan. Method 1000 at 1002 may determine a second power threshold based on a different combination of devices forming the second power actuatable devices when the first power actuatable device is the control surface. Accordingly, method 1000 at 1008 may adjust the power threshold based on the different power requirements corresponding to the control commands for the first power actuatable device.

In another embodiment, differences in power requirement may be based on different control commands for the first power actuatable device. For instance, referring to the non-limiting embodiment above, where the first power actuatable device is the fan, a first control command for increasing fan speed may include a power requirement different from a second control command for another change in fan speed.

In certain embodiments, method 1000 at 1010 includes receiving a plurality of control commands each corresponding to respective power actuatable devices. Each control command corresponding to respective power actuatable devices include a respective power requirement for operation of each power actuatable device based on the control command. Method 1000 may include at 1012 determining a combination of power requirements having a sum below a power limit. Method 1000 at 1040 may include providing power to a combination of power actuatable devices corresponding to the combination of power requirements having the sum below the power limit.

In an exemplary embodiment, a user or control schedule may generate and transmit a plurality of control commands each corresponding respectively to operation of the fans, compressors, expansion devices, and control surfaces, such as provided at 1010. Method 1000 compares a plurality of power requirements associated with each respective control command and determines a combination of power requirements having a sum below the power limit, such as provided at 1012. Based on the determined combination, power is provided to the respective power actuatable devices.

In an exemplary non-limiting embodiment, a first combination of power requirements may include the compressors and expansion devices, resulting in providing power for operation of the compressors and expansion devices. Fans and control surfaces are then excluded from concurrent operation with the devices associated with the first combination of power requirements (i.e., the compressors and expansion devices in the present non-limiting example). In various embodiments, method 1000 may iterate such that the excluded devices (i.e., the fans and control surfaces in the present non-limiting example) are the first power actuatable devices and the associated non-executed control commands are the control commands in accordance with method 1000 at 1010. Method 1000 then monitors and determines when power draw by one or more of the devices associated with the first combination has ceased or reduced, such that the power receiving state decreases below the power threshold, such as provided at 1020, 1030. Method 1000 may compare the power requirements associated with the first power actuatable devices and determine a second combination of power requirements having a sum below the power limit. The second combination may be associated with one or both previously excluded devices (i.e., one or both of the fans and control surfaces in the present non-limiting example). Based on the determined second combination, power is provided to or drawn by the power actuatable devices associated with the second combination. Method 1000 may iterate until all control commands are fulfilled.

In various embodiments, method 1000 at 1040 includes serially providing power to each power actuatable device based on the plurality of control commands.

Referring to the exemplary non-limiting embodiment provided above, a first combination of power requirements including the compressors and expansion devices may result in fans and control surfaces excluded from concurrent operation with the devices associated with the first combination of power requirements. Method 1000 may iterate such that the excluded devices are the first power actuatable devices and the associated non-executed control commands are the control commands in accordance with method 1000 at 1010. Method 1000 then monitors and determines when power draw by one or more of the devices associated with the first combination has ceased or reduced, such that the power receiving state decreases below the power threshold, such as provided at 1020, 1030. When the power receiving state decreases below the power threshold, method 1000 at 1040 serially provide power to, or allow power draw, by the fan and the control surfaces.

In still various embodiments, method 1000 includes at 1001 receiving, or otherwise obtaining, a priority hierarchy of the plurality of power actuatable devices. In such an embodiment, method 1000 includes at 1011 comparing a plurality of power requirements each corresponding to respective control commands to the priority hierarchy of the plurality of power actuatable devices. Method 1000 at 1012 may include determining a combination of power requirements having a sum below a power limit based on the priority hierarchy. Method 1000 at 1040 may include providing power to a combination of power actuatable devices corresponding to the priority hierarchy and the combination of power requirements having the sum below the power limit.

The priority hierarchy forms a list, chart, tabulation, schedule, ranking, or other ordering of power actuatable devices that establishes which power actuatable devices should receive power (or allow power draw) before others. The priority hierarchy may include conditions corresponding to which power actuatable devices may receive power before other power actuatable devices. Conditions may correspond a power receiving state of each power actuatable device. Accordingly, a first ordering of power actuatable devices may correspond to a first combination of power actuatable devices having a first combination of power receiving states and a second ordering of power actuatable devices may correspond to a second combination of power actuatable devices having a second combination of power receiving states, etc.

In an exemplary embodiment, a user or control schedule may generate and transmit a plurality of control commands each corresponding respectively to operation of the fans, compressors, expansion devices, and control surfaces, such as provided at 1010. Method 1000 compares a plurality of power requirements each corresponding to respective control commands to a priority hierarchy of the plurality of power actuatable devices, such as provided at 1011. Method 1000 determines a combination of power requirements having a sum below the power limit and based on the priority hierarchy, such as provided at 1012. Accordingly, the power actuatable devices that draw power based on the determined combination is within the power limit and maintains operational performance of the air conditioner unit by having higher priority devices actuate before, or along with, certain other devices.

Referring to the exemplary non-limiting embodiment provided above, method 1000 may determine a combination of power requirements that includes the compressors and expansion devices based on a priority hierarchy requiring compressors and expansion devices to operate concurrently, or before operation of other devices, such as fans and control surfaces, while determining the combination of power requirements corresponding to the compressors and expansion devices is within the power limit.

Embodiments of the air conditioner unit 10, controller 120, and method 1000 provided herein allow for operating an appliance with a limited power supply. In certain embodiments, the limited power supply is less than approximately 15 Watts, such as to reduce risks associated with electric shock. Embodiments provided herein allow for operating a plurality of power actuatable devices within the limited power supply, such as to avoid risks associated with a larger power supply and circuit overload.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit, the air conditioner unit comprising:

a plurality of power actuatable devices, the plurality of power actuatable devices comprising a first power actuatable device and a second power actuatable device at the air conditioner unit;

a controller in operable communication with the plurality of power actuatable devices, the controller configured to:

receive a control command corresponding to providing power to the first power actuatable device;

obtain a power limit of the air conditioner unit, wherein the power limit corresponds to a threshold above which a circuit may be overloaded or tripped;

determine a power threshold, wherein the power threshold is a difference of the power limit and a power input to the second power actuatable device in a power receiving state;

compare a power requirement corresponding to the control command to the power limit and the power threshold;

determine whether the second power actuatable device is in the power receiving state below the power threshold or above the power threshold;

when the power receiving state of the second power actuatable device is above the power threshold, monitor the power receiving state of the second power actuatable device until the power receiving state is below the power threshold; and when the power receiving state of the second power actuatable device is below the power threshold, provide power to the first power actuatable device based on the control command.

2. The air conditioner unit of claim 1, the controller configured to:

adjust the power threshold based on the second power actuatable device receiving power and the power requirement corresponding to the control command for the first power actuatable device.

3. The air conditioner unit of claim 1, the controller configured to:

receive a plurality of control commands each corresponding to respective power actuatable devices;

determine a combination of power requirements having a sum below a power limit; and provide power to a combination of power actuatable devices corresponding to the combination of power requirements having the sum below the power limit.

4. The air conditioner unit of claim 1, the controller configured to:

receive a plurality of control commands each corresponding to respective power actuatable devices; and serially provide power to each power actuatable device based on the plurality of control commands.

5. The air conditioner unit of claim 1, the controller configured to:

receive a priority hierarchy of the plurality of power actuatable devices;

receive a plurality of control commands each corresponding to respective power actuatable devices;

compare a plurality of power requirements each corresponding to respective control commands to the priority hierarchy of the plurality of power actuatable devices;

determine a combination of power requirements having a sum below a power limit based on the priority hierarchy; and provide power to a combination of power actuatable devices corresponding to the combination of power requirements having the sum below the power limit and the priority hierarchy.

6. The air conditioner unit of claim 1, wherein the air conditioner unit is a packaged terminal air conditioner unit.

7. The air conditioner unit of claim 1, wherein the plurality of power actuatable devices comprises a fan, a compressor, a heat exchanger, a heating unit, an expansion device, a control surface, or combinations thereof.

8. A method for operating an appliance, the appliance comprising a plurality of power actuatable devices, the method comprising:

receiving a control command corresponding to providing power to a first power actuatable device;

obtaining a power limit of the air conditioner unit, wherein the power limit corresponds to a threshold above which a circuit may be overloaded or tripped;

determining a power threshold, wherein the power threshold is a difference of the power limit and a power input to the second power actuatable device in a power receiving state;

comparing a power requirement corresponding to the control command to the power limit and the power threshold;

determining whether a second power actuatable device is in the power receiving state below the power threshold or above the power threshold;

when the power receiving state of the second power actuatable device is above the power threshold, monitoring the power receiving state of the second power actuatable device until the power receiving state is below the power threshold; and when the power receiving state of the second power actuatable device is below the power threshold, providing power to the first power actuatable device based on the control command.

9. The method of claim 8, the method comprising:

adjusting the power threshold based on the second power actuatable device receiving power and the power requirement corresponding to the control command for the first power actuatable device.

10. The method of claim 8, the method comprising:

receiving a plurality of control commands each corresponding to respective power actuatable devices;

determining a combination of power requirements having a sum below a power limit; and providing power to a combination of power actuatable devices corresponding to the combination of power requirements having the sum below the power limit.

11. The method of claim 8, the method comprising:

receiving a priority hierarchy of the plurality of power actuatable devices;

receiving a plurality of control commands each corresponding to respective power actuatable devices;

comparing a plurality of power requirements each corresponding to respective control commands to the priority hierarchy of the plurality of power actuatable devices;

determining a combination of power requirements having a sum below a power limit based on the priority hierarchy; and providing power to a combination of power actuatable devices corresponding to the combination of power requirements having the sum below the power limit and the priority hierarchy.

12. A controller for an appliance, the controller comprising a memory device and a processor, the memory device configured to store instructions that, when executed by the processor, causes the controller to perform operations, the operations comprising:

receiving a control command corresponding to providing power to a first power actuatable device at the appliance;

obtaining a power limit of the air conditioner unit, wherein the power limit corresponds to a threshold above which a circuit may be overloaded or tripped;

determining a power threshold, wherein the power threshold is a difference of the power limit and a power input to the second power actuatable device in a power receiving state;

comparing a power requirement corresponding to the control command to the power limit and the power threshold;

determining whether a second power actuatable device at the appliance is in the power receiving state below the power threshold or above the power threshold;

when the power receiving state of the second power actuatable device is above the power threshold, monitoring the power receiving state of the second power actuatable device until the power receiving state is below the power threshold; and when the power receiving state of the second power actuatable device is below the power threshold, generating a command signal corresponding to providing power to the first power actuatable device based on the control command.

13. The controller of claim 12, the operations comprising:

adjusting the power threshold based on the second power actuatable device receiving power and the power requirement corresponding to the control command for the first power actuatable device.

* * * * *